United States Patent [19]

Zitser et al.

[11] 4,411,586

[45] Oct. 25, 1983

[54] DEVICE FOR DELIVERY OF CORES

[76] Inventors: Vitaly A. Zitser, ulitsa Pervomaiskaya, 9/14, kv. 17, Dolgoprudny, Moskovskaya oblasti; Leonid V. Bachelis, Schelkovskoe shosse, 91, korpus 2, Moscow; Alexandr V. Melnikov, ulitsa Dorozhnaya, 7, korpus 1, kv. 138, Moscow; Igor I. Dreishev, Volgogradsky prospekt, 181, kv. 33, Moscow; Nikolai K. Shishkin, ulitsa Yablochkova, 29, kv. 17, Moscow; Jury E. Morozov, Leninsky prospekt, 39/1, kv. 264, Moscow; Vladimir A. Ivanov, ulitsa Rustaveli, 3, korpus 6, kv. 34, Moscow; Semen A. Olshansky, Dmitrovskoe shosse, 37, kv. 306, Moscow; July V. Ryabinin, Altufievskoe shosse, 30, kv. 210, Moscow, all of U.S.S.R.

[21] Appl. No.: 283,787

[22] Filed: Jul. 15, 1981

[30] Foreign Application Priority Data

Jul. 15, 1980 [SU] U.S.S.R. ..... 2944501

[51] Int. Cl.[3] ..... B66F 9/02

[52] U.S. Cl. ..... 414/728; 164/180; 164/213; 248/421; 198/488; 198/774; 414/750; 414/917

[58] Field of Search ..... 414/228, 917, 749–752, 414/680, 684; 248/169, 188.2, 188.3, 585, 421; 164/169, 180, 213, 227, 269, 344–346; 198/488, 774

[56] References Cited

U.S. PATENT DOCUMENTS

| | | | |
|---|---|---|---|
| 1,757,722 | 5/1930 | Johnson | 414/917 |
| 1,870,906 | 8/1932 | Gottschalk et al. | 414/917 X |
| 3,161,284 | 12/1964 | Ashworth | 198/774 |
| 3,233,758 | 2/1966 | Darfus | 414/728 |

*Primary Examiner*—Douglas C. Butler
*Assistant Examiner*—Terrance L. Siemens
*Attorney, Agent, or Firm*—Steinberg & Raskin

[57] ABSTRACT

A core delivery device of a machine for making cores from fluidized sands in hot boxes comprises apparatus for receiving cores and delivering them onto bearing plate bars mounted on a support frame. The apparatus in question is made in the form of a pantograph positioned on a trolley which, in turn, is mounted for reciprocation on the support frame. The pantograph is provided with core receiving bars which are lifted and lowered by an appropriate mechanism.

8 Claims, 3 Drawing Figures

DEVICE FOR DELIVERY OF CORES

FIELD OF THE INVENTION

The present invention relates to machines for making cores from fluidized sands in hot boxes, and more particularly, to a core delivery device incorporated in such machines.

The invention is applicable for use at mass-production plants of, for example, the sanitary engineering industry, automobile industry, electrical engineering and machine-building industries.

BACKGROUND OF THE INVENTION

Of late, the hot-box process of making cores directly in core boxes have found extensive application in foundry practice the world over.

Foundry plants of the machine-building industry are now engaged in the production of core-making machines which are based on the above-mentioned operating principle.

This type of core-making machine incorporates a core-blowing machine, devices for separation of core boxes and for delivery of finished cores, appliances for heating the core boxes, and transport means for conveying these boxes from one station to another. There are known shuttle- and rotary-type core-making machines (see, for example, a book by G. V. Prosianik, G. I. Bobriakov, V. A. Sokolova, P. G. Danilevskaya, M. K. Sokov, V. V. Lubimov, entitled "Production of Cores in Hot Boxes," Mashinostroenie Publishers, Moscow, 1970, pp. 147–148, 152–154).

The core delivery device, incorporated in such machines, normally comprises a delivery table and a drive for its rotation or movement. After the core box has been disassembled, the cores are transferred onto the delivery table. In the machines designed for the production of small-size cores, the delivery tables are made rotatable so as to deliver cores from the core box directly, or over an inclined surface, into a charging trough from where they are removed by an operator.

The delivery tables incorporated in the machines designed for the production of large-size cores are usually made for horizontal movement, during which the cores are delivered to an operator. The removal of cores from the tables and their further delivery onto transport means are carried out manually.

Since in the hot-box process the hardening of sand proceeds uniformly under the effect of heat and a catalyst due to a rapid polymerization of a bender, there is no necessity in weighing the cores.

There is known another core-making process which consists in that a fluidized sand is packed under pressure in a hot box (cf. U.S. Pat. No. 3,802,484, Cl. 164–169).

The cores made in accordance with the above method have an interior channel or porosity which ensure effective ventilation of the cores at a time when metal is poured into a mould and when an ingot undergoes cooling. This being the case, the cores are preferably weighed with the purpose of determining the size of the interior channel or the extent of their porosity before they are removed from the machine.

There is also known a multi-station machine for producing cores from fluidized sands in hot boxes. The machine is made in two stages and has floating core boxes. The removal of cores directly from the delivery table is impossible. Mounted on the lower stage of the machine are transport means and delivery tables. Arranged on the upper stage of the machine in the direction of the technological process are a device for preparation of sand, a packing mechanism, a pusher, a heating chamber, a device for separating core boxes, and a device for the delivery of finished cores.

The core delivery device of this machine comprises a trolley mounted for reciprocation on a support frame and carrying an arrangement for receiving cores and delivering them onto the bearing plate bars mounted on the support frame (see, for example, patent application No. 2,057,318 laid out with the UK Patent Office on Apr. 1, 1981).

In the core delivery device referred to above, the mechanism for receiving cores and delivering them onto the bearing plate bars is made in the form of a Y-shaped plate mounted on the trolley and having its projections directed towards a core box and carrying stops fitted on the butt ends thereof.

The trolley incorporated in the above device has dogs for pushing the cores. The bearing plate bars have horizontal and inclined sections, the latter being directed towards the core box. The horizontal section of the plate is arranged at a level somewhat higher than the plane of the Y-shaped plate in which lies the core, the lower end of the inclined section of each bearing plate bar being disposed below this plane.

The above-described device for the delivery of cores operates as follows.

As the trolley moves toward the disassembled core box, the Y-shaped plate of the core receiving and delivering arrangement is brought under the core positioned on the core-box pushers; the pushers are lowered to place the core on the Y-shaped plate. Further, the trolley is caused to move in the opposite direction, the core is withdrawn from the core box and, running against the inclined section of the bearing plate bars, is pushed thereon by means of the stops provided in the core receiving and delivering arrangement. With each travelling cycle of the trolley, the core is pushed further along over the inclined and then over the horizontal section of the bearing plate bars to a weighing means and then to a core discharging station.

While moving over the bearing plate bars from the core box to the core discharging station, the core wears out under the action of its weight. As this happens, the film of a binding agent is removed, the surface smoothness is deteriorated, and collapsibility of the core is due to occur at the places of its wear. This, in turn, may lead to the production of defective ingots.

The fact that the cores are pushed over the bearing plate bars renders impossible the transportation of complex-shaped cores having protruded parts on their lower surfaces.

Moreover, the above construction of the core delivery device complicates their delivery onto a weighing means, as well as onto transport means for conveying the cores to successive stations.

SUMMARY OF THE INVENTION

It is an object of the present invention to improve the quality of cores produced by a core-making machine.

Another object of the invention is to ensure effective transportation of complex-shaped cores having protruded parts on their lower surfaces.

Still another object of the invention is to create favourable conditions for the delivery of cores onto a weighing means and onto transport means to be thereby conveyed for further operations at successive stations.

These and other objects of the invention are obtained in a core delivery device of a machine for making cores from fluidized sands in hot boxes, comprising a trolley mounted for reciprocation on a support frame and carrying a means for receiving the cores and delivering them onto bearing plate bars mounted on the support frame, according to the invention, the core receiving and delivering means is made in the form of a pantograph mounted on the trolley and carrying bars adapted to receive the cores, said bars being arranged on the pantograph side opposite to the trolley and provided with a mechanism for their lifting and lowering.

When in initial position, the rotatable bars of the pantograph are preferably oriented in the direction of the in-coming core boxes.

The mechanism for lifting and lowering the core receiving bars is preferably provided with stops fixed on the pantograph rotatable bars, and with stops fixed on the support frame and co-operating with the first-mentioned stops so as to permit the core receiving bars to be lifted when the trolley with the pantograph moves toward the core box, and to be lowered when the trolley with the pantograph moves in the opposite direction.

The mechanism for lifting and lowering the core receiving bars is preferably made in the form of a power cylinder mounted on the trolley and having its rod connected with at least one rotatable bar of the pantograph.

The core delivery device is preferably provided with adjustable stops positioned on the pantograph rotatable bars and with adjustable stops positioned on the trolley for co-operation with the first-mentioned stops so as to permit the pantograph receiving bars to be fixed in the upper position as the trolley is brought to a stop at the end of its travel to the core box, and in the lower position when the trolley is brought to a stop while moving in the opposite direction.

Such construction of the core delivery device makes it possible to improve the quality of cores produced by a core-making machine, to ensure effective transportation of complex-shaped cores having protruding parts on their lower surfaces, and to create favourable conditions for the delivery of cores to a weighing means and then onto transport means for conveying the cores for further operations at succesive stations.

BRIEF DESCRIPTION OF THE DRAWINGS

The invention will now be described, by way of example only, with reference to the accompanying drawings, wherein.

DETAILED DESCRIPTION OF THE PREFERRED EMBODIMENT

Figure 1:
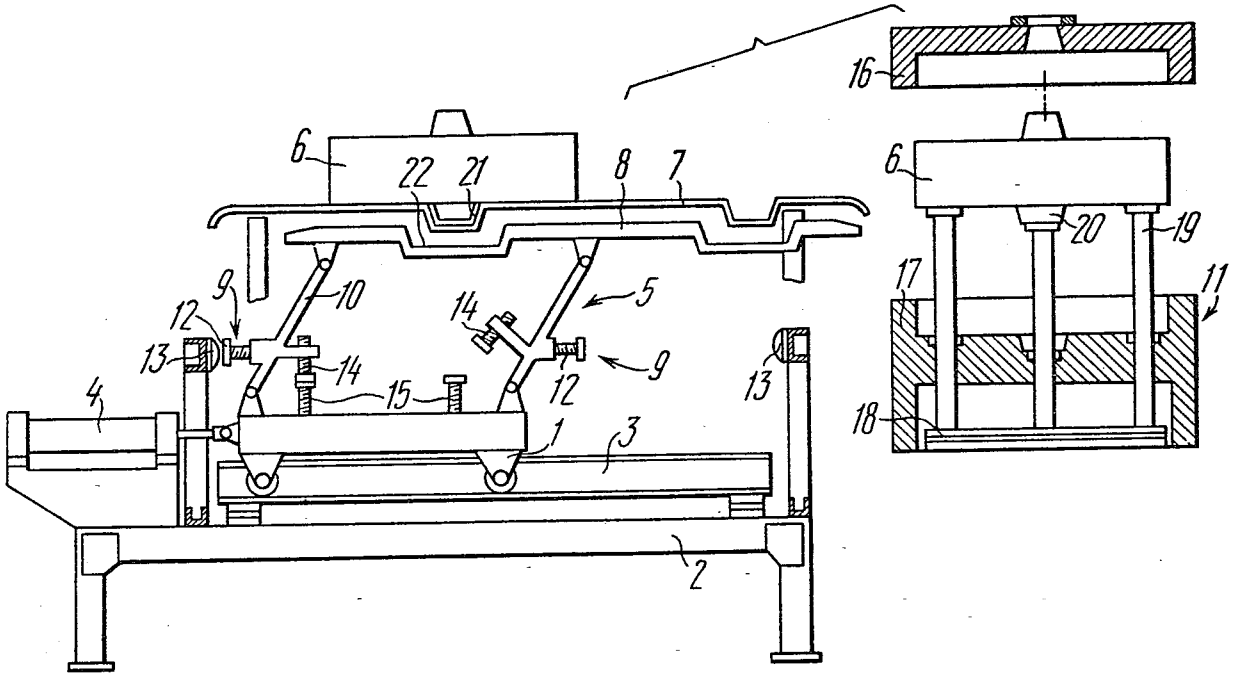
FIG. 1 is a front view of a core delivering device, with the core receiving bars in the lower position, and a core box shown in longitudinal section.

Referring now to the above drawings and to FIG. 1 in particular, there is shown therein a core delivery device of a machine for making cores from fluidized sands in hot boxes. The core delivery device comprises a trolley 1 mounted for reciprocation on support frame 2 on guides 3, and actuated by a power cylinder 4. The trolley 1 carries an arrangement 5 for receiving cores 6 and delivering them onto bearing plate bars 7 positioned on the support frame 2.

The arrangement 5 for receiving the cores 6 and for delivering them onto the bearing plate bars is made in the form of a pantograph (to be further referred to as pantograph 5), which is mounted on the trolley 1 and carries bars 8 adapted to receive the cores 6. The core receiving bars 8 are arranged on the side of the pantograph 5 that is opposite to the trolley 1, and are provided with a mechanism 9 by means of which they are lifted and lowered. In the preferred embodiment of the invention, the core receiving bars 8 make up the side of the pantograph 5 that is opposite to the trolley 1. When in initial position, the rotatable bars 10 of the pantograph 5 are oriented toward the in-coming core boxes 11.

Figure 2:
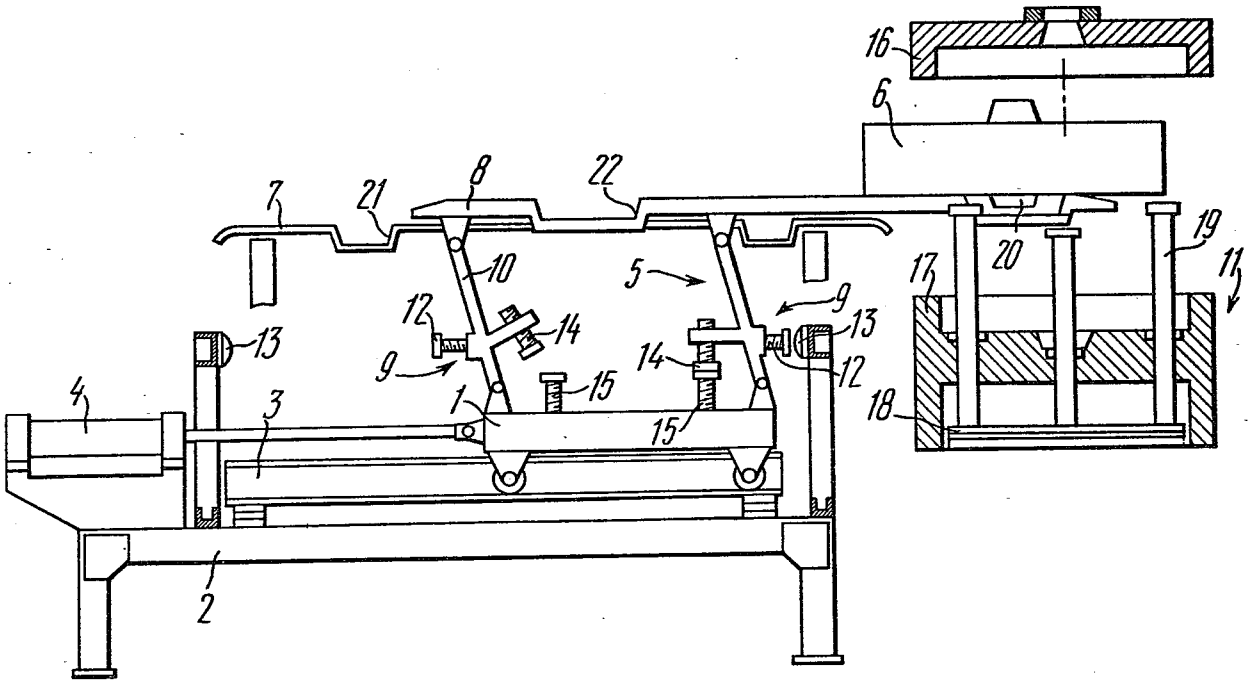
FIG. 2 is same as FIG. 1, except that the core receiving bars of a pantograph are shown in the upper position.

The mechanism 9 for lifting and lowering the bars 8, adapted to receive the cores 6, includes stops 12 which are fixed on the rotatable bars 10 of the pantograph 5, and stops 13 fixed on the support frame 2 and co-operating with the stops 12 so as to cause the core receiving bars 8 to be lifted when the trolley 1 with the pantograph 5 move toward the core box 11, such as shown in FIG. 2, and to be lowered when the trolley 1 with the pantograph 5 move in the opposite direction, such as shown in FIG. 1 The stops 12 are made adjustable. However, other stops may be made adjustable as well.

The frame mounted stops 13 are thus provided at regions of the frame 2 proximate to and distal from the incoming core boxes. The bar mounted stops 12, which constitute first bar mounted stops, are adapted to abut against the frame mounted stops 13 to lift the core receiving bars 8 as the trolley moves both toward and away from the core box, i.e., toward the proximate and distal regions of the frame 2.

The device of the invention has adjustable stops 14 which are fixed on the rotatable bars 10 of the pantograph 5, and adjustable stops 15 which are positioned on the trolley 1 for co-operation with the stops 14 so as to restrain the receiving bars 8 of the pantograph 5 fixed in the upper position when the trolley 1 with the pantograph 5 are brought to a stop on the way to the core box 11, such as shown in FIG. 2, and in the lower position when the trolley 1 with the pantograph 5 are brought to a stop while moving in the opposite direction, such as shown in FIG. 1.

As seen in FIG. 1, when in their lower position, the core receiving bars 8 are situated in a substantially horizontal plane situated below a plane in which the bearing plate bars 7 are situated. As seen in FIG. 2, when in their upper position, the core receiving bars 8 are situated in a substantially horizontal plane situated above the plane in which the bearing plate bars 7 are situated. The bar mounted stops 14, which constitute second bar mounted stops, are thus provided on the bars 10 which are proximate to and distal from the incoming core boxes. Respective second bar mounted stops 14 are adapted to abut against respective ones of the trolley mounted stops 15 to restrain the receiving bars 8 fixed in the lower and upper positions as seen in FIGS. 1 and 2 respectively.

The core box 11 shown in FIGS. 1 and 2 does not form a part of the subject of the present invention and is only herein illustrated to facilitate understanding of the operating principle of the device according to the invention. The core box 11 is depicted in the drawings when brought apart, with its top section shown at 16 and its bottom section, at 17. Accommodated in the bottom section 17 of the core box 11 is a pusher system 18 with pushers 19 carrying the core 6 of an intricate shape, having its lower surface formed with a protruding portion 20. The bearing plate bars 7 and core receiving bars 8 are respectively formed with depressions 21 and 22, which are provided to receive the protruding portion 20 of the core 6.

Figure 3:
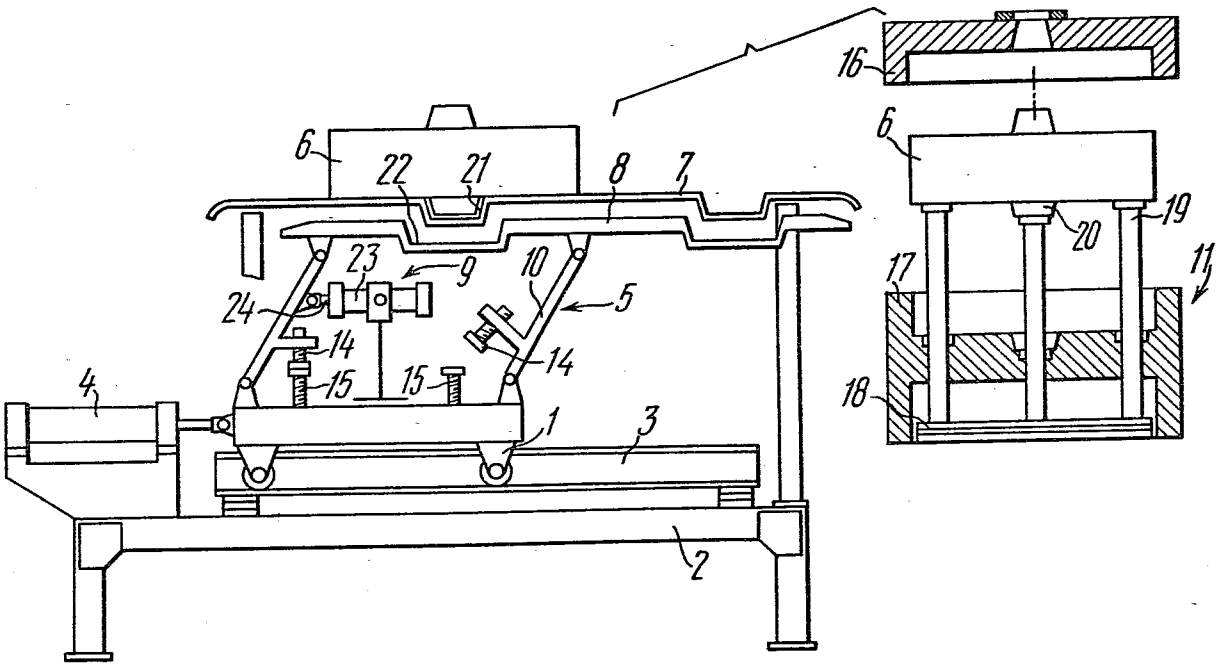
FIG. 3 is a front view of another embodiment of the invention, with a core box shown in longitudinal section.

Another embodiment of the invention, shown in FIG. 3, is similar in construction to the embodiment illustrated in FIGS. 1 and 2, with the exception that the mechanism 9 for lifting and lowering the core receiving bars 8 is made in the form of a power cylinder 23 mounted on the trolley 1. The cylinder 23 has its rod 24 connected to the rotatable bars 10 of the pantograph 5. The cylinder rod may be connected only to one of the pantograph bars.

The core delivery device of the invention operates as follows.

The trolley 1 (FIG. 1) with the pantograph 5 and the core receiving bars 8, in the lower position, are driven by the power cylinder 4 along the guides 3 toward the core box 6. At this moment the core box 11 is in disassembled form and the core 6, after being removed therefrom, is positioned on the pushers 19 of the pusher system 18. At the end of travel of the trolley 1, when the receiving bars 8 of the pantograph 5 have been brought under the core 6, the stops 12 of the mechanism 9 run against the stops 13 of the latter, which are positioned closer to the core box 11. As the stops 12 (FIG. 2) interact with the stops 13, and the trolley 1 is moved further on toward the core box 11, the rotatable bars 10 of the pantograph 5 are turned in the direction opposite to that in which the core box 11 is positioned. As a result, the core receiving bars 8 are lifted to receive the core 6, thereby removing it from the pushers 19, and then, on reaching the topmost position, the bars 8 are slightly lowered until the stops 14 run against the stops 15 positioned closer to the core box 11. In this new position, the bars 8 are higher than the bearing plate bars 7.

The trolley 1 is returned to its initial position, and the core receiving bars 8 are actuated to move the core 6 over the bearing plate bars 7. At the end of travel of the trolley 1 (FIG. 1), the stops 12 run against the stops 13 which are spaced furthermost away from the core boxes 11. As the stops 12 interact with the stops 13 and the trolley continues to move away from the core box 11, the rotatable bars 10 of the pantograph 5 are caused to turn in the direction of the next in-coming core box 11. The core receiving bars 8 again occupy their topmost position and then are lowered until the stops 14 run against the stops 15 which are spaced furthermost from the core box 11. In this position, the core receiving bars 8 are lower than the bearing plate bars 7, whereby the core 6 remains on the bearing plate brs 7 as they are moved from the upper to lower position. This completes the operating cycle of the device.

The embodiment of the invention, shown in FIG. 3, has the following operational distinction from the previously described embodiment.

After the trolley 1 has reached the core box 11 and the receiving bars 8 have been brought under the core 6, the cylinder 23 of the mechanism 9 is operated to rotate the bars 10 of the pantograph 5, and the bars 8 occupy their upper position, thereby receiving the core 6. When the trolley 1 is returned to its initial position, the cylinder 23 is operated to bring the bars 10 of the pantograph 5 back to their initial position. Meantime, the bars 8 are brought down to occupy their lower position. In the course of this downward movement of the bars 8, the core 6 is transferred to remain on the bearing plate bars 7.

Another distinctive operational feature of the device according to the invention lies in the following. Once the pantograph 5 (FIGS. 1–3) is brought to the core box 11 and the receiving bars 8 are fixed in the upper position, the pusher system 18 is lowered, the core 6 is placed on the bars 8, whereupon the trolley 1 with the pantograph 5 are returned to initial position.

With the core delivery according to the invention it becomes possible to improve the quality of cores produced by a core-making machine, to expand production potentialities of a machine for making cores from fluidized sands in hot boxes, and to create favourable conditions for the delivery of cores to a weighing means and onto transport means for conveying cores for further operation at successive stations.

For the sake of clarity, particular specific terminology is used but the invention is no way limited by the terms so adopted and it should be borne in mind that each such term covers all equivalent elements operating in a similar manner and employed for solving similar problems.

While the invention has been described in terms of the preferred embodiments, numerous variations may be made in the device illustrated in the drawings and herein described without departing from the invention as set forth in the appended claims.

What is claimed is:

1. A core delivery device of a machine for making cores from fluidized sands in hot boxes, comprising:

a support frame;

a trolley mounted for reciprocation on said support frame;

bearing plate bars mounted on said support frame, said bearing plate bars being shaped to correspond to the configuration of the cores and being situated in a substantially fixed horizontal plane;

means for receiving the said cores and delivering them onto said bearing plate bars, said means being constituted by a pantograph mounted on said trolley and having rotatable bars and bars adapted to receive said cores, the core receiving bars being arranged on the pantograph side opposite to the trolley, said core receiving bars being shaped to correspond to the configuration of the cores and being situated in a substantially horizontal plane; and a mechanism for lifting and lowering said core receiving bars between lower and upper positions, said plane in which said core receiving bars are situated being situated below said plane in which said bearing plate bars are situated when said core receiving bars are in said lower position and above said plane in which said bearing plate bars are situated when said core receiving bars are in said upper position.

2. A device as set forth in claim 1, wherein the rotatable bars of said pantograph are oriented, when in an initial position, in the direction of the in-coming core boxes.

3. A device as set forth in claim 1, comprising:

adjustable bar mounted stops fixed on the rotatable bars of said pantograph;

adjustable trolley mounted stops fixed on the trolley for abutting interaction with bar mounted stops so as to restrain the core receiving bars of said pantograph in the upper position when the trolley with said pantograph are moved toward the core box, and in the lower position when the trolley with the pantograph are moved in the opposite direction.

4. A device as set forth in claim 2, wherein said mechanism for lifting and lowering the core receiving bars comprises first bar mounted stops fixed on said rotatable bars of said pantograph;

frame mounted stops fixed on said support frame for abutting cooperation with the first bar mounted stops so as to cause the core receiving bars to be lifted when the trolley with the pantograph are moved toward the core box, and to be lowered when the trolley with the pantograph are moved in the opposite direction.

5. A device according to claim 2, wherein said mechanism for lifting and lowering the core receiving bars comprises a power cylinder mounted on said trolley including a piston rod connected to at least one of the rotatable bars of said pantograph.

6. A device according to claim 2, comprising adjustable bar mounted stops provided on the rotatable bars of said pantograph;

adjustable trolley mounted stops provided on said trolley for abutting interaction with the bar mounted adjustable stops so as to restrain the core receiving bars of said pantograph fixed in the upper position when the trolley is brought to a stop at the end of its travel to said core box, and in the lower position when the trolley is brought to a stop while moving in the opposite direction.

7. A device according to claim 4, comprising second adjustable bar mounted stops provided on the rotatable bars of said pantograph;

adjustable trolley mounted stops provided on said trolley for abutting interaction with the second adjustable bar mounted stops so as to restrain the core receiving bars of said pantograph fixed in the upper position when the trolley is brought to a stop at the end of its travel to said core box, and in the lower position when the trolley is brought to a stop while moving in the opposite direction.

8. A device according to claim 5, comprising adjustable bar mounted stops provided on the rotatable bars of said pantograph;

adjustable trolley mounted stops provided on said trolley for abutting interaction with the adjustable bar mounted stops so as to restrain the core receiving bars of said pantograph fixed in the upper position when the trolley is brought to a stop at the end of its travel to said core box, and in the lower position when the trolley is brought to a stop while moving in the opposite direction.

* * * * *